US010150303B2

(12) United States Patent
Tsuchimoto

(10) Patent No.: US 10,150,303 B2
(45) Date of Patent: Dec. 11, 2018

(54) PRINTER AND PRINTING METHOD

(71) Applicant: TOSHIBA TEC KABUSHIKI KAISHA, Tokyo (JP)

(72) Inventor: Hiroshi Tsuchimoto, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/816,657

(22) Filed: Nov. 17, 2017

(65) Prior Publication Data

US 2018/0072071 A1 Mar. 15, 2018

Related U.S. Application Data

(63) Continuation of application No. 15/432,430, filed on Feb. 14, 2017.

(30) Foreign Application Priority Data

Apr. 1, 2016 (JP) ..... 2016-074436

(51) Int. Cl.

| | |
|---|---|
| ***B41J 3/36*** | (2006.01) |
| ***B41J 3/407*** | (2006.01) |
| ***B41J 23/02*** | (2006.01) |
| ***B41J 29/13*** | (2006.01) |

(52) U.S. Cl.

CPC ..... *B41J 3/36* (2013.01); *B41J 3/4075* (2013.01); *B41J 23/025* (2013.01); *B41J 29/13* (2013.01)

(58) Field of Classification Search

CPC ..... B41J 3/36; B41J 3/4075

See application file for complete search history.

(56) References Cited

U.S. PATENT DOCUMENTS

| | | | |
|---|---|---|---|
| 2011/0200377 | A1 | 8/2011 | Iga |
| 2011/0274476 | A1 | 11/2011 | Preliasco et al. |
| 2017/0222434 | A1 | 8/2017 | Yoshikoshi et al. |

OTHER PUBLICATIONS

Extended European Search Report dated Oct. 10, 2017, filed in European counterpart Patent Application No. 17161391.2, 9 pages.

U.S. Office Action dated Mar. 30, 2018, filed in related U.S. Appl. No. 15/432,430 (8 pages).

*Primary Examiner* — Julian Huffman

(74) *Attorney, Agent, or Firm* — Patterson & Sheridan, LLP

(57) ABSTRACT

According to an embodiment, there is provided a printer including a plurality of printing modes. A first printing mode is a printing mode for discharging a label by a transfer device, the label being still attached to a backing sheet. A second printing mode is a printing mode for discharging the label by the transfer device while peeling off the label from the backing sheet. The printer controls power supply from a storage battery such that a printing device performs printing at a first printing speed when the printing mode is the first printing mode and such that the printing device performs the printing at a second printing speed when the printing mode is the second printing mode, the second printing speed being slower than the first printing speed.

6 Claims, 11 Drawing Sheets

PRINTER AND PRINTING METHOD

CROSS-REFERENCE TO RELATED APPLICATIONS

This application is a continuation of U.S. patent application Ser. No. 15/432,430, filed on Feb. 14, 2017, which is based upon and claims the benefit of priority from the prior Japanese Patent Application No. 2016-074436, filed on Apr. 1, 2016, the entire contents of each of which are incorporated herein by reference.

FIELD

An embodiment described here generally relates to a printer and a printing method.

BACKGROUND

In the past, some printers that issue receipts or labels have been mainly assumed to be carried for use. Such a portable printer is power-fed from a storage battery (battery) to operate.

Some of the portable printers receive a selection of a printing mode. Options of the printing mode are, for example, a peel-off mode and a continuous mode. The continuous mode is a printing mode for performing printing on labels attached to a backing sheet and issuing the printed labels (continuous issue). The peel-off mode is a printing mode for issuing the printed labels while peeling off the printed labels from the backing sheet (peel-off issue).

The portable printers described above use, for example, torque generated by a motor for a force for peeling off the labels from the backing sheet. The motor generates torque in accordance with the amount of current provided. The torque is unnecessary in the continuous mode.

However, in the portable printers of the related art, a value of the current flowing in the motor is set to suit the peel-off issue. So, the limited power of the battery is consumed for the generation of torque, which is intrinsically unnecessary in the continuous mode. This is undesirable.

DETAILED DESCRIPTION

According to one embodiment, there is provided a printer including a printing device, a transfer device, a storage battery, and a processor. The printing device performs printing on a label attached to a backing sheet at a first printing speed and a second printing speed slower than the first printing speed. The transfer device transfers the label to the printing device and discharges the label subjected to the printing by the printing device with still attached to the backing sheet when a printing mode is a first printing mode. Further, the transfer device transfers the label to the printing device, peels off the label subjected to the printing by the printing device from the backing sheet and discharges the peeled off label when the printing mode is a second printing mode. The storage battery supplies power to the printing device and the transfer device. The processor controls power supply from the storage battery such that the printing device performs the printing at the first printing speed when the printing mode is the first printing mode. Further, the processor controls the power supply from the storage battery such that the printing device performs the printing at the second printing speed when the printing mode is the second printing mode.

Figure 1:
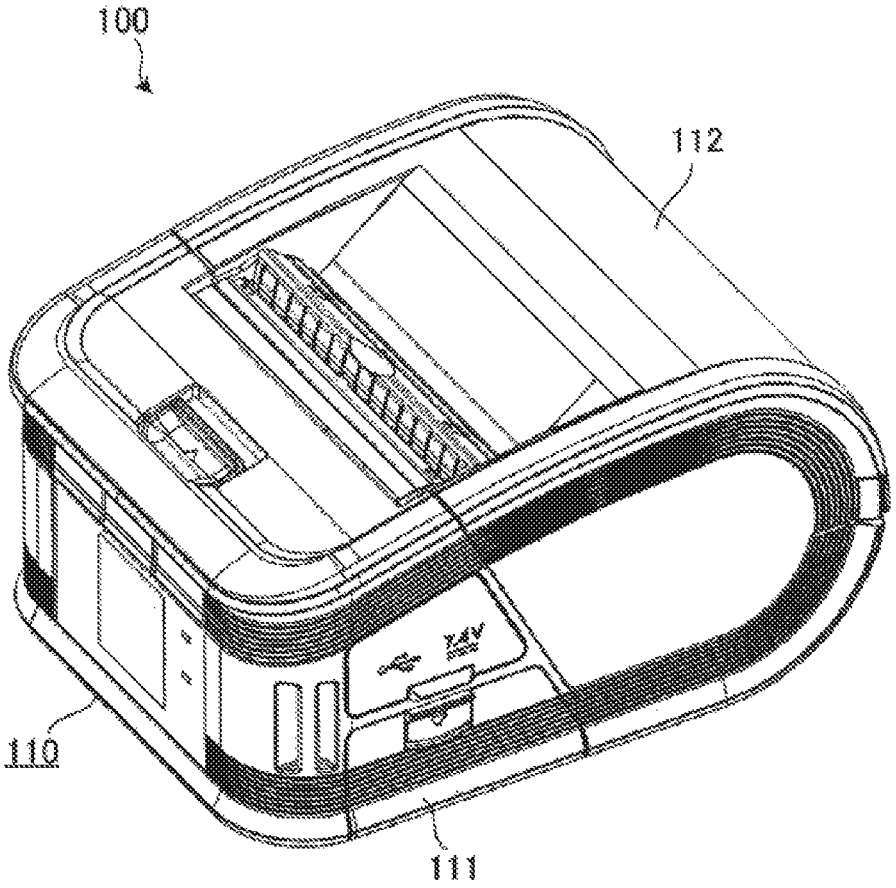
FIG. 1 is a perspective view of an outer appearance of a printer according to an embodiment.

Hereinafter, an embodiment will be further given with reference to the drawings. FIG. 1 is a perspective view of an outer appearance of a printer 100 according to this embodiment. The printer 100 includes a casing 110 and incorporates various components in the casing 110. In the figures, the same reference symbols denote the same or similar portions.

Figure 2A:
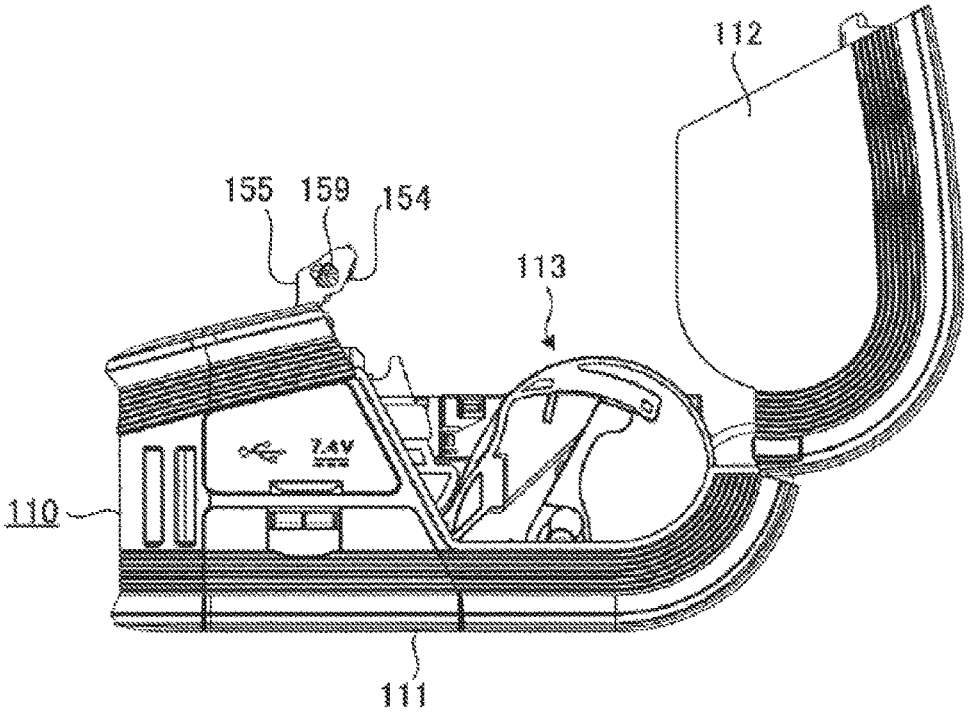
FIG. 2A is a side view of the outer appearance of the printer with a cover opened according to the embodiment.
Figure 2B:
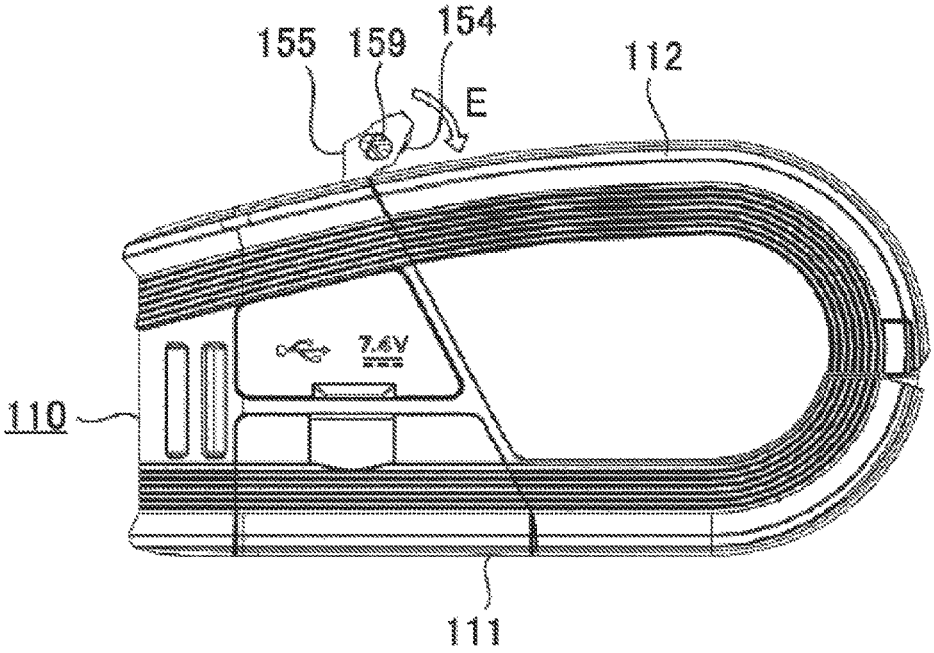
FIG. 2B is a side view of the outer appearance of the printer with the cover closed according to the embodiment.

The casing 110 is separated from a main body 111 and a cover 112. FIG. 2A is a side view of the outer appearance of the printer 100 with the cover 112 opened. FIG. 2B is a side view of the outer appearance of the printer 100 with the cover 112 closed. The main body 111 includes an opening that is opened and closed by the cover 112. An end of the cover 112 is pivotably fixed to the main body 111. The cover 112 opens and closes the opening of the main body 111 according to the pivoting.

The main body 111 includes an accommodation device 113 that accommodates a printing medium. The printing medium used in the printer 100 of this embodiment is strip-shaped. The accommodation device 113 accommodates a rolled printing medium.

Specific examples of the printing medium include a receipt sheet, a backing-sheet-attached label, and a linerless label (label without backing sheet). The receipt sheet is a strip-shaped sheet that is cut after printing and to be a receipt. The backing-sheet-attached label includes an adhesive layer on the back surface of a printing surface thereof and is attached to a strip-shaped backing sheet. The linerless label is a strip-shaped sheet including an adhesive layer on the back surface thereof.

Figure 4A:
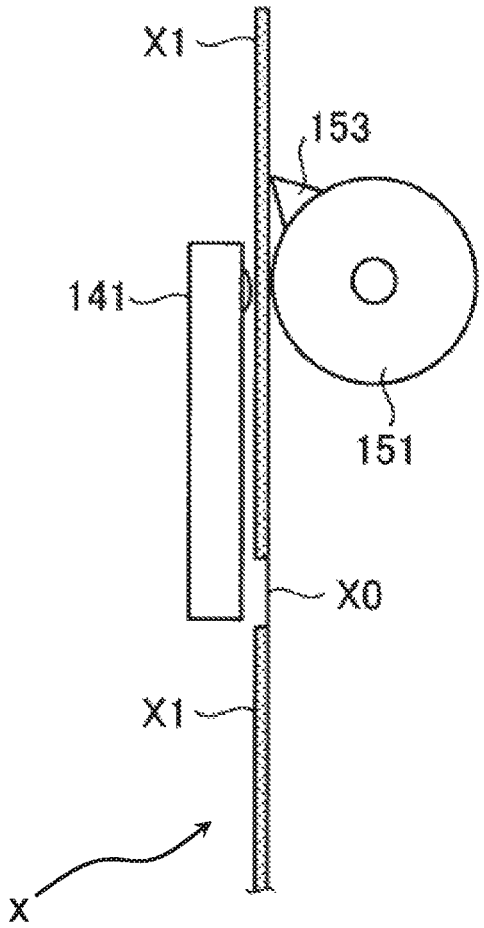
FIG. 4A is a schematic diagram of a printing device and a transfer device in a continuous mode of the printer according to the embodiment.

Any of the printing media described above includes a heat sensitive coloring layer on the printing surface, for example. In the embodiment, it is assumed that the backing-sheet-attached label is used as a printing medium. The backing-sheet-attached label of this embodiment includes, as shown in FIG. 4A, for example, a backing sheet X0 and labels X1 attached to the backing sheet X0. It should be noted that in the following description both of the labels X1 attached to the backing sheet X0 and the labels X1 peeled off from the backing sheet X0 may be collectively referred to as labels X. Further, in this embodiment, description will be given on power feeding that is set to correspond to a printing mode in which the printing medium is the labels X1 attached to the backing sheet X0. The printer 100 has a plurality of printing modes. The printing modes are switched according to an operation of a user. The printing modes include a first printing mode (continuous mode) and a second printing mode (peel-off mode), which will be described later.

Figure 3:
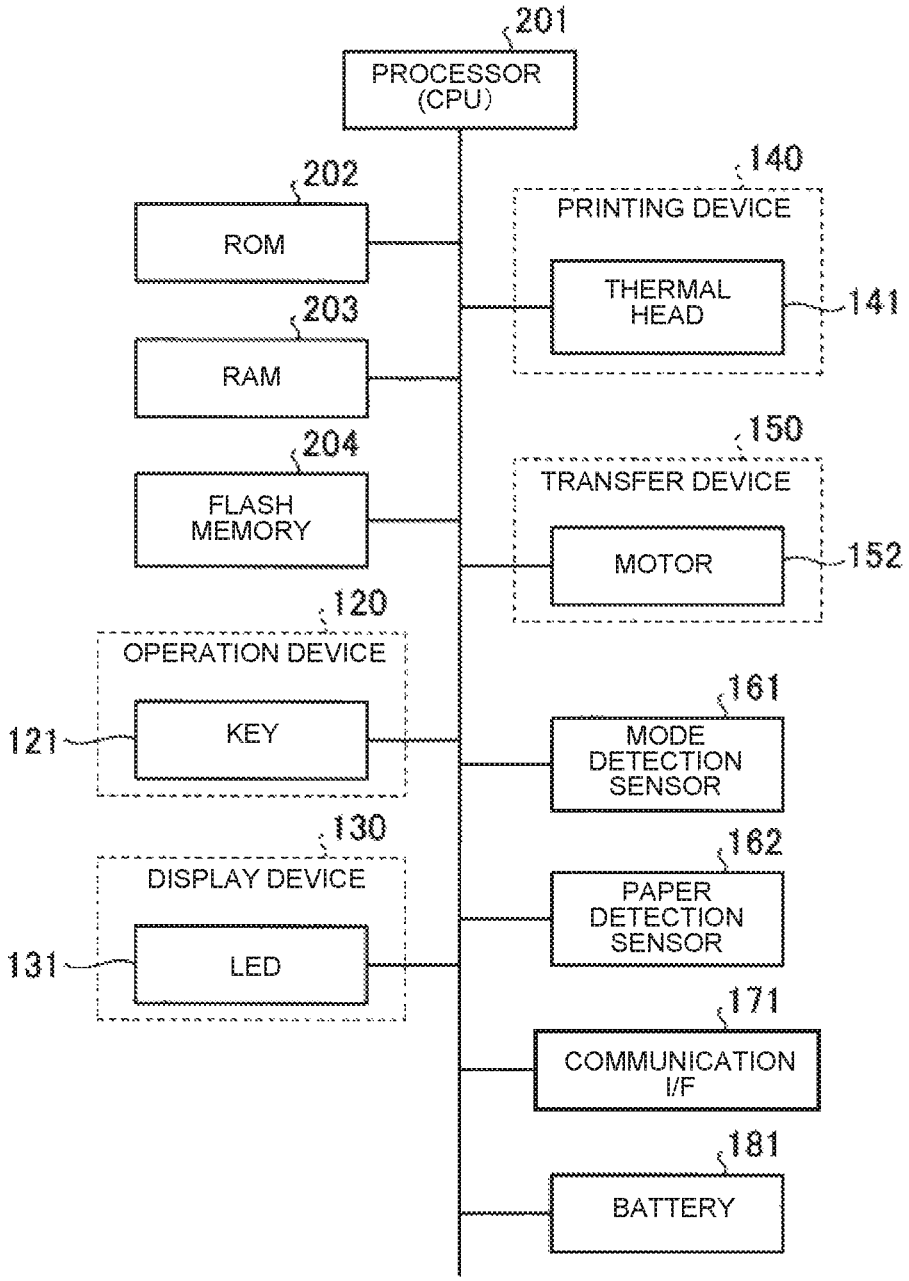
FIG. 3 is a block diagram showing electrical connection of electrical components of the printer according to the embodiment.

FIG. 3 is a block diagram showing electrical connection of electrical components of the printer 100. The printer 100 includes an operation device 120, a display device 130, a printing device 140, a transfer device 150, a mode detection sensor 161, a paper detection sensor 162, a communication interface (I/F) 171, a battery (storage battery) 181, a processor 201, a ROM (Read Only Memory) 202, a RAM (Random Access Memory) 203, and a flash memory 204. In order to operate the units described above, the battery 181 supplies power to those units. Hereinafter, supply of power may be described simply as power feeding.

The ROM 202 stores various programs executed by the CPU 201. The RAM 203 rewritably stores variable data. Further, the RAM 203 is used as a work area. The processor 201 is a central processing unit (CPU). The processor 201 decompresses programs, which are stored in the ROM 202, in the RAM 203 and executes various types of arithmetic processing, to thus function as various modules and collectively control the units of the printer 100. The flash memory 204 is a rewritable non-volatile memory that stores various types of setting information or the like.

The operation device 120 receives various operations from the user via various keys 121 (outer appearances thereof are not shown), which are provided to the surface of the casing 110. The operation device 120 transmits details of the operations to the processor 201. The display device 130 transmits various types of information such as a behavior status to the user via various light-emitting diodes (LEDs) 131 provided to the surface of the casing 110, according to a control signal from the processor 201.

The printing device 140 performs printing on the labels X1, which are attached to the backing sheet X0, at a first printing speed and a second printing speed that are described later. The printing device 140 includes a thermal head 141, for example. The printing device 140 performs printing on the labels (printing medium) X by the thermal head 141 according to a control signal from the processor 201. The thermal head 141 includes a plurality of heating elements disposed along a width direction of the label X. The width direction of the label X is a direction that is parallel to the printing surface of the label X and orthogonal to a transfer direction of the label X. The thermal head 141 is provided within the main body 111. For the thermal head 141, the number of simultaneously energizable heating elements (the upper limit of the number of simultaneously energizable elements) is determined according to the amount of current per unit time, the current being generated by power supplied from the battery 181. In order to correspond to the upper limit, the thermal head 141 divides 1 line in multiple pieces (time division) for printing, in accordance with the amount of current. The number of time divisions is about 1 to 4, for example. The number of time divisions of 1 means that there is no division.

Figure 4B:
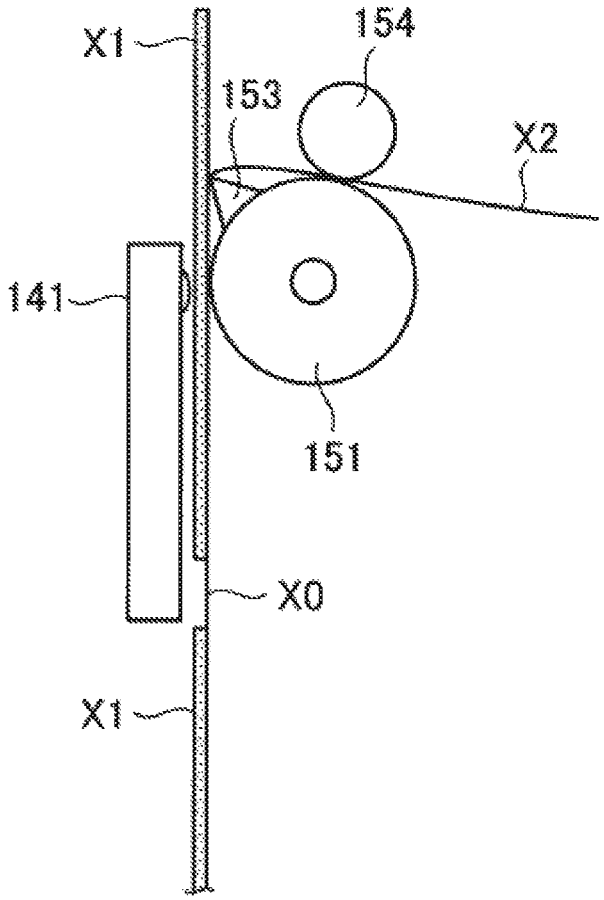
FIG. 4B is a schematic diagram of the printing device and the transfer device in a peel-off mode of the printer according to the embodiment.

FIGS. 4A and 4B are schematic diagrams of structures of the printing device 140 and the transfer device 150. The transfer device 150 transfers the labels (printing medium) X according to a control signal from the processor 201. The transfer device 150 includes a platen roller 151, a motor 152 (see FIG. 3), a peel-off base 153, a peel-off roller 154, and a switching device 155 (see, for example, FIG. 5B). The transfer device 150 causes those units to cooperate with one another to achieve a peel-off function. In other words, the transfer device 150 has a peel-off function and functions as a peel-off device.

The platen roller 151 is provided to the cover 112. Specifically, the platen roller 151 is provided, in the cover 112, in the vicinity of an end farther from a pivot shaft of the cover 112. As described above, the thermal head 141 is provided within the main body 111. Specifically, the thermal head 141 is provided, in the main body 111, at a position coming into pressure contact with the platen roller 151 in a state where the cover 112 is located at a position closing the opening of the main body 111.

The platen roller 151 presses the label (printing medium) X against the thermal head 141 and also rotates, to transfer the label X sandwiched between the platen roller 151 and the thermal head 141. The transfer device 150 drives the motor 152 according to a control signal from the processor 201. The motor 152 generates torque to rotate the platen roller 151. The torque generated by the motor 152 corresponds to a value of current flowing in the motor 152 by power feeding from the battery 181.

The printer 100 has the printing modes, i.e., the first printing mode and the second printing mode. FIG. 4A is a diagram of the switching device 155 in the first printing mode. FIG. 4B is a diagram of the switching device 155 in the second printing mode. The first printing mode is a printing mode for continuously performing printing on the labels X1 attached to the backing sheet X0 and continuously discharging the printed labels X1 still attached to the backing sheet X0 to the outside of the printer 100. Hereinafter, the first printing mode may be referred to as a continuous mode. The second printing mode is a printing mode for discharging the printed labels X1 to the outside of the printer 100 while peeling off the printed labels X1 from the backing sheet X0. Hereinafter, the second printing mode may be referred to as a peel-off mode. Further, the discharge of the printed labels X to the outside of the printer 100 is referred to as issue. Furthermore, the discharge of the printed labels X1 in the continuous mode is referred to as continuous issue. The discharge of the printed labels X1 in the peel-off mode is referred to as peel-off issue.

The peel-off base 153 is provided in the vicinity of an issue port (not shown in the figure) from which the labels X are issued. The peel-off base 153 has a surface for guiding the back surface of the backing sheet X0 in the peel-off issue. Such a surface is curved at an acute angle. The peel-off base 153 drastically changes the transfer direction of the backing sheet X0 by use of the shape of the peel-off base 153, and guides the backing sheet X0 to a direction in which the backing sheet X0 is peeled off from the label X1.

In the peel-off issue, the peel-off roller 154 presses the back surface of the backing sheet against the platen roller 151 after the backing sheet is curved by the peel-off base 153. Hereinafter, the backing sheet curved by the peel-off base 153 is referred to as a backing sheet X2. In other words, the backing sheet X2 is sandwiched between the platen roller 151 and the peel-off roller 154 on the downstream side of the transfer direction of the labels X with respect to the peel-off base 153. This sandwiched portion receives torque, i.e., a transfer force from the platen roller 151, so that the backing sheet X2 is transferred in a direction moving farther from the adhesive layer of the label X1.

Figure 5A:
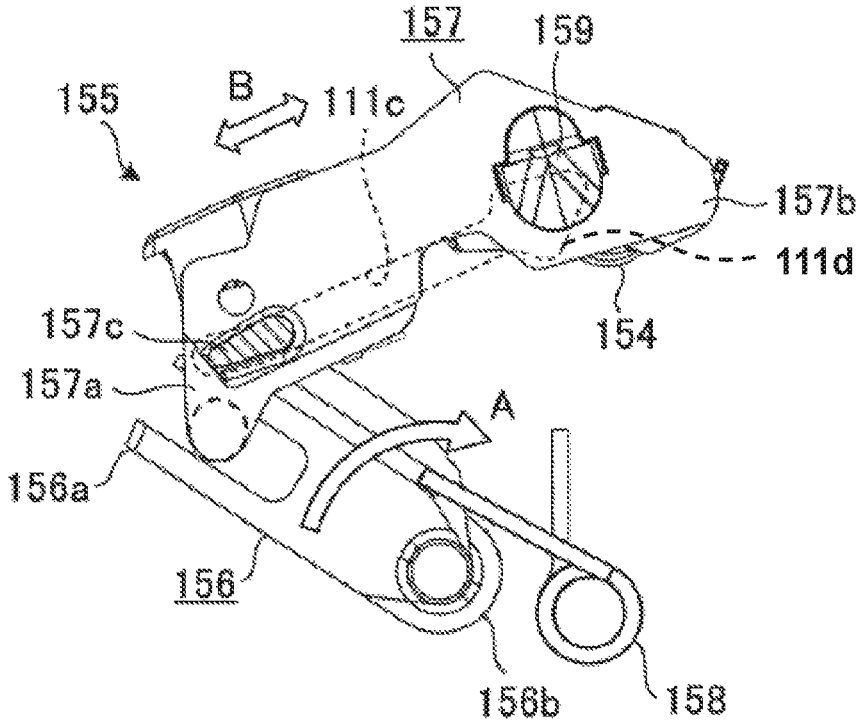
FIG. 5A is a side view of a switching device in the peel-off mode in the printer according to the embodiment.
Figure 5B:
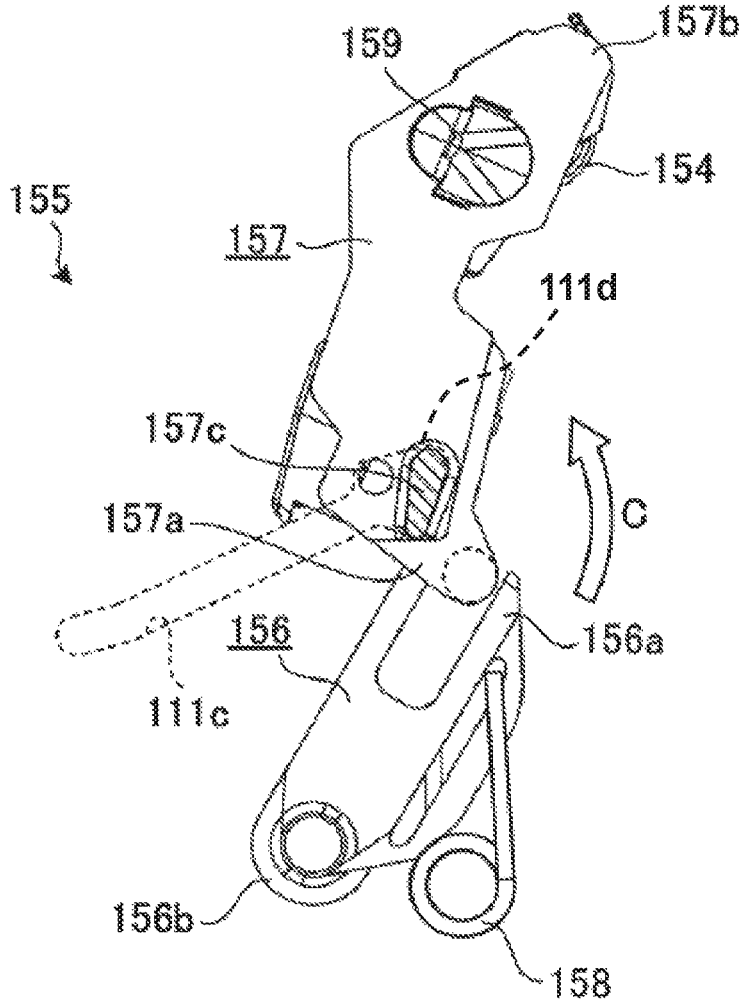
FIG. 5B is a side view of the switching device in the continuous mode in the printer according to the embodiment.
Figure 6:
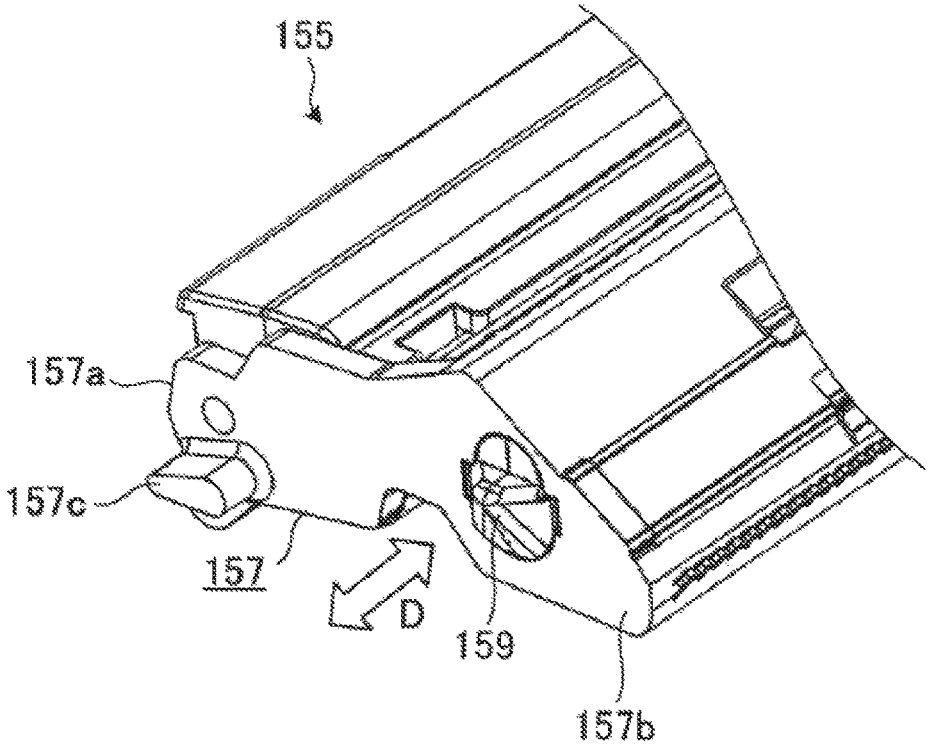
FIG. 6 is a perspective view of an outer appearance of the switching device of the printer according to the embodiment.

FIG. 5A is a side view of the switching device 155 in the peel-off mode. FIG. 5B is a side view of the switching device 155 in the continuous mode. FIG. 6 is a perspective view of an outer appearance of the switching device 155.

The switching device 155 includes a roller support mechanism shown in FIG. 5A, for example. Hereinafter, the switching device 155 may be referred to as a roller support mechanism 155. The roller support mechanism 155 rotatably supports both ends of the peel-off roller 154. As shown in FIGS. 5A and 5B, the roller support mechanism 155 is configured to have an arm shape so as to be foldable at a portion corresponding to the elbow of an arm.

More specifically, the roller support mechanism 155 includes a first member 156, a second member 157, a torsion spring 158, and a lock hook 159. One end 156*a* of the first member 156 and one end 157*a* of the second member 157 are pivotably connected to each other.

The main body 111 pivotably supports the other end 156*b* of the first member 156. The torsion spring 158 is provided at that support position. The torsion spring 158 biases the first member 156 to the main body 111 in one pivot direction (indicated by the arrow A in FIG. 5A). This bias direction is a direction in which the roller support mechanism 155 is extended.

The peel-off roller 154 is rotatably coupled to the other end 157*b* of the second member 157. The second member 157 includes a guide projection 157*c* at a position near the end 157*a*. The guide projection 157*c* is fitted into a guide groove 111*c* formed in the main body 111, and is guided within the guide groove 111*c*, to thus be movable.

The guide groove 111*c* is provided in the main body 111 such that a longitudinal direction of the guide groove 111*c* faces a direction substantially extending along the upper surface of the casing 110. The guide groove 111*c* restricts the moving direction of the guide projection 157*c* to a direction of the arrow B shown in FIG. 5A. This enables the second member 157 to move in the direction of the arrow B.

A termination 111*d* of the guide groove 111*c*, i.e., a portion that the guide projection 157*c* reaches when the folded roller support mechanism 155 is extended has a shape vertically expanded in FIG. 5A. Further, the guide projection 157*c* has a flat side shape in a vertical cross section. This enables the second member 157 to pivot in a direction of the arrow C shown in FIG. 5B when the guide projection 157*c* moves and reaches the termination 111*d* of the guide groove 111*c*.

The lock hook 159 is provided with a helical spring (not shown in the figure). The lock hook 159 can come in and out in a direction indicated by the arrow D in FIG. 6 from an engaging recess (not shown in the figure) due to the bias of the helical spring. The engaging recess is provided to the main body 111. As shown in FIG. 5A, the lock hook 159 is engaged with the engaging recess with the roller support mechanism 155 being folded. With this configuration, the lock hook 159 maintains the roller support mechanism 155 in a state of being accommodated in the main body 111 against the bias of the torsion spring 158. It should be noted that the printer 100 includes a lever (not shown in the figure) that releases the engagement of the lock hook 159 and the engaging recess.

Here, the roller support mechanism 155 shown in FIGS. 2A and 2B is in the same state as the roller support mechanism 155 shown in FIG. 5B. FIG. 2A shows a state where the user opens the cover 112 and takes out the roller support mechanism 155 from the main body 111. When the user closes the cover 112 from this state (see FIG. 2B) and causes the roller support mechanism 155 to pivot in a direction indicated by the arrow E, the printer 100 is switched to the peel-off mode (see FIG. 4B). In other words, with the roller support mechanism 155 being folded, the peel-off roller 154 comes into close contact with the platen roller 151, and the printing mode of the printer 100 is switched to the peel-off mode. Further, with the roller support mechanism 155 being extended, the peel-off roller 154 is separated from the platen roller 151, and the printing mode of the printer 100 is switched to the continuous mode.

The mode detection sensor 161 is a sensor for detecting the folded state of the roller support mechanism 155, i.e., detecting that the printing mode is the peel-off mode. The mode detection sensor 161 is, for example, an optical sensor or a mechanical switch. The mode detection sensor 161 detects the position of the peel-off roller 154. The mode detection sensor 161 outputs a signal indicating a detection result to the processor 201.

The paper detection sensor 162 is a sensor for measuring timing of printing. The paper detection sensor 162 is, for example, a transmissive or reflective optical sensor. The paper detection sensor 162 detects a mark on the label X1 or the backing sheet X0, the mark being made in black, for example. The paper detection sensor 162 outputs a signal indicating a detection result to the processor 201.

The communication I/F 171 performs data communication with a portable terminal device or the like, which is an external device of the printer 100, according to a control signal from the processor 201. For example, the communication I/F 171 receives printing data.

Figure 7:
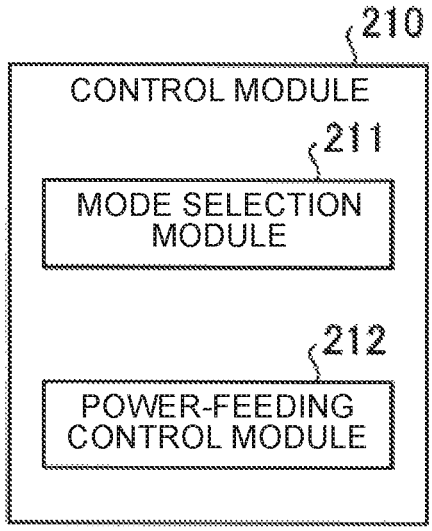
FIG. 7 is a block diagram showing a functional configuration of a processor of the printer according to the embodiment.

The processor 201 decompresses programs, which are stored in the ROM 202, in the RAM 203 and executes the programs, to thus function as a control module 210 shown in FIG. 7. FIG. 7 is a block diagram showing a functional configuration of the control module 210. The control module 210 includes a mode selection module (mode detection module) 211 and a power-feeding control module 212. The control module 210 collectively controls the units of the printer 100.

The mode selection module 211 receives a selection of any of the printing modes, i.e., the continuous mode and the peel-off mode. More specifically, the mode selection module 211 determines whether the printing mode of the printer 100 is the continuous mode or the peel-off mode on the basis of the output from the mode detection sensor 161. In other words, the mode selection module 211 detects the present printing mode.

The power-feeding control module 212 controls the amount of power supplied from the battery 181 to the thermal head 141 and the motor 152 according to the printing mode determined by the mode selection module 211. Due to a change in the amount of power, the amount of current supplied to the thermal head 141 and the motor 152 is changed.

The control module 210 controls the power-feeding control module 212 to make a printing speed for the labels X in the continuous mode (first printing speed) faster than a printing speed for the labels X in the peel-off mode (second printing speed). In other words, when the printing mode is the continuous mode (first printing mode), the control module 210 controls power supply from the battery 181 such that the printing device 140 performs printing at the first printing speed. Further, when the printing mode is the peel-off mode (second printing mode), the control module 210 controls power supply from the battery 181 such that the printing device 140 performs printing at the second printing speed. This control will be described later.

In each printing mode, the amount of current supplied from the battery 181 to the motor 152 is determined. The amount of current differs depending on the printing mode. The motor 152 generates torque corresponding to the amount of current supplied. The amount of current capable of being supplied by the battery 181 is limited. When the current for the motor 152 is secured, the amount of current capable of being supplied to the thermal head 141 is automatically determined.

If the current for the motor 152 is increased so as to obtain large torque, the amount of current capable of being supplied to the thermal head 141 is reduced. Conversely, if the current flowing in the motor 152 is reduced in a situation where too much torque is not necessary, the amount of current capable of being supplied to the thermal head 141 is increased. When the amount of current capable of being supplied to the thermal head 141 is increased, the number of simultaneously energizable heating elements is increased. This can reduce the number of time divisions of the thermal head 141. As a result, printing can be finished rapidly. In other words, the printing speed is made faster.

In each of the printing modes, priority is given to the printing speed of the printing device 140 or the transfer force of the transfer device 150. In the continuous mode, the printing speed takes priority. In the peel-off mode, the transfer force (torque) takes priority. In other words, in the continuous mode, power-feeding to the thermal head 141 takes priority, and in the peel-off mode, power-feeding to the motor 152 takes priority. In each printing mode, various set values are determined depending on what takes priority.

When the label X1 is subjected to printing, the upper limit Ih of current capable of being consumed in the thermal head 141 can be calculated by the following expression (1).

$$Ih = Ib - Im - Io \qquad \text{Expression (1)}$$

where Ib represents the upper limit of current capable of being output by the battery, Im represents a value of current consumed by the motor 152, and Io represents a value of current consumed by another circuit.

The details of the above description will be more specifically given. In the peel-off mode (see FIG. 4B), the peel-off roller 154 comes into pressure contact with the platen roller 151. This makes the platen roller 151 more difficult to rotate than in the continuous mode (see FIG. 4A). Therefore, the platen roller 151 needs larger torque and the motor 152 thus needs a larger current.

Further, in the peel-off mode, after the user removes the issued label X1, the printer 100 issues the next label X1. In other words, in the peel-off mode, if the labels X1 are intermittently issued (discharged), it does not cause a serious inconvenience. Reduction in time for printing per label is not so demanded as in the continuous mode.

Meanwhile, in the continuous mode, the printer 100 does not peel off the labels X1 from the backing sheet X0, and sequentially performs printing on the labels X1 attached to the backing sheet X0 and then issues the labels X1. In other words, the continuous mode is a printing mode adequate for the case where reduction in time for printing per label (improvement in printing speed) is demanded. In the continuous mode, the peel-off roller 154 does not come into contact with the platen roller 151. Thus, the load on the motor 152 is smaller than that in the peel-off mode.

As described above, the current value Im of the motor 152 in the continuous mode, which is necessary to appropriately rotate the platen roller 151, is smaller than the current value Im of the motor 152 in the peel-off mode. The current value Ih, which can be consumed in the thermal head 141 in the continuous mode, is higher than the current value Ih in the peel-off mode.

On the basis of the details described above, a proper value of the amount of current (current value Im) flowing in the motor 152 for each printing mode is determined. The flash memory 204 stores the proper value as a set value for each printing mode.

When the proper value of a current value Ix for each printing mode is denoted by "Ix (printing mode)", a magnitude relation between the proper values is expressed as follows.

$$Im(\text{continuous mode}) < Im(\text{peel-off mode}) \qquad \text{Expression (2)}$$

$$Ih(\text{continuous mode}) > Ih(\text{peel-off mode}) \qquad \text{Expression (3)}$$

Further, the number of simultaneously energizable heating elements of the thermal head 141, N, is expressed by a monotonically increasing function of Ih. Therefore, when the proper value of the number of simultaneously energizable heating elements N for each printing mode is denoted by "N (printing mode)", a magnitude relation between the proper values is expressed as follows.

$$N(\text{continuous mode}) > N(\text{peel-off mode}) \qquad \text{Expression (4)}$$

On the basis of the details described above, the proper value of the number of simultaneously energizable heating elements N for each printing mode is determined. The flash memory 204 stores the proper value as a set value for each printing mode.

The processor 201 functions as the power-feeding control module 212, to thus control distribution of the power supplied from the battery 181 and control the amount of current flowing in the thermal head 141 and the motor 152. The power-feeding control module 212 performs the above control according to the set value determined for the printing mode selected by the mode selection module 211.

For the control described above, the power-feeding control module 212 refers to the flash memory 204 to read the set value corresponding to the printing mode. With this configuration, the power-feeding control module 212 controls the power-feeding so as to provide a larger amount of current to the thermal head 141 in the continuous mode and provide a larger amount of current to the motor 152 in the peel-off mode, according to the set value corresponding to the present printing mode.

Figure 8:
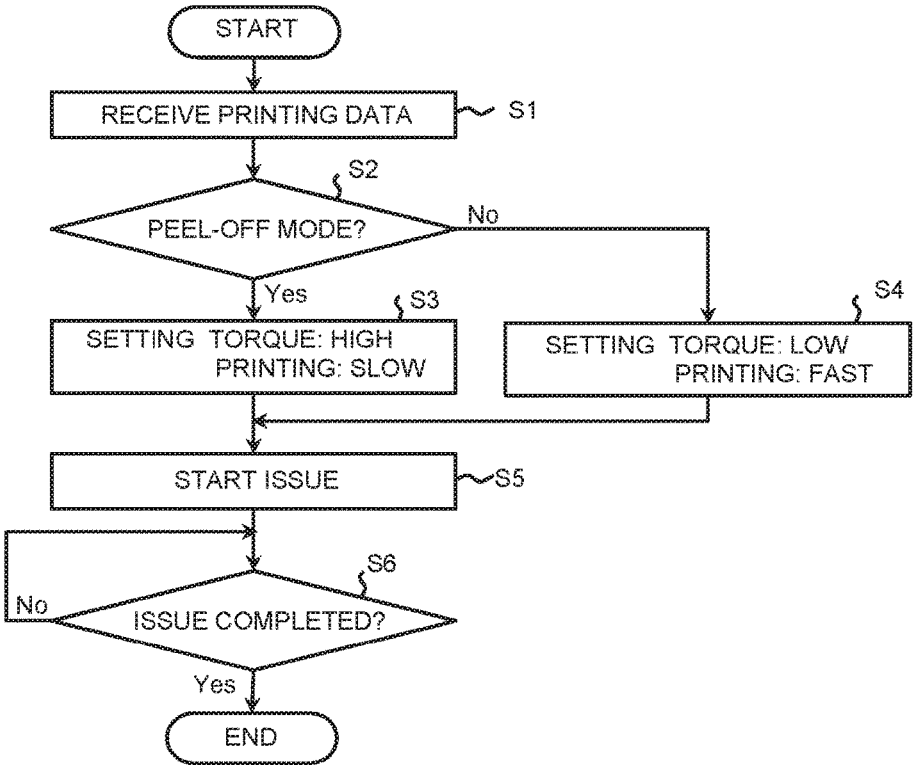
FIG. 8 is a flowchart showing processing performed by the processor of the printer according to the embodiment.

Hereinafter, the control performed by the processor 201 (control module 210) will be described with reference to FIG. 8. In Step S1 shown in FIG. 8, the processor 201 receives printing data from an external device via the communication I/F 171. Next, in Step S2, the processor 201 functions as the mode selection module 211 to determine whether the printing mode of the printer 100 is switched to the continuous mode or the peel-off mode.

When the printing mode is the peel-off mode (Yes in Step S2), the processing of the processor 201 proceeds to Step S3. In Step S3, the processor 201 (control module 210) functions as the power-feeding control module 212 to control power-feeding adequate for the peel-off mode on the basis of setting information stored in the flash memory 204. This control increases the torque of the motor 152 and slows down the printing speed of the printing device 140. In other words, the processor 201 performs power-feeding such that the printing device performs printing at the second printing speed.

When the printing mode is the continuous mode (No in Step S2), the processing of the processor 201 proceeds to Step S4. In Step S4, the processor 201 (control module 210)

functions as the power-feeding control module 212 to control power-feeding adequate for the continuous mode on the basis of setting information stored in the flash memory 204. This control reduces the torque of the motor 152 and increases the printing speed of the printing device 140. In other words, the processor 201 performs power-feeding such that the printing device performs printing at the first printing speed.

When the power-feeding control is terminated in Step S3 or Step S4, the processor 201 (control module 210) starts printing on the labels X1 and issue of the labels X1 in Step S5. The processor 201 continues printing and issue until printing of all the printing data received in Step S1 is completed (No in Step S6). When printing of all the printing data received in Step S1 is completed, the processor 201 terminates the processing (Yes in Step S6).

As described above, according to the printer 100 of this embodiment, in the continuous mode (first printing mode), the power supplied to the motor 152 can be effectively used for heat generation of the heating elements of the thermal head 141. When a large amount of power is supplied to the thermal head 141, many heating elements are made simultaneously energizable. This can reduce the number of time divisions of the thermal head 141 and increase the printing speed. In other words, according to this embodiment, the printing speed in the continuous mode can be increased.

It should be noted that in the embodiment the amount of current of the motor 152 is changed depending on whether the printing mode is the continuous mode (first printing mode) or the peel-off mode (second printing mode), but an actual embodiment is not limited to this embodiment. For example, in the peel-off mode, the labels X1 may be peeled off over time without increasing the torque of the motor 152. In other words, the amount of current Im of the motor 152 adequate for the continuous mode may be used in the peel-off mode. In another embodiment, according to the switching of the printing mode, only the amount of current Ih of the thermal head 141 is changed. More specifically, the amount of current Ih of the thermal head 141 in the continuous mode is increased more than that in the peel-off mode. According to another embodiment, while the time for peeling off the labels X1 from the backing sheet X0 in the peel-off mode is increased, a sufficiently fast printing speed can be obtained in the continuous mode. Further, according to another embodiment, since power consumption can be suppressed in the peel-off mode, long-lasting of the battery 181, i.e., an operating time of the printer 100 can be elongated.

Further, in the embodiment described above, the issue of the labels X1 attached to the backing sheet X0 has been described as an example. However, in an actual embodiment, the embodiment described above may be applied to power-feeding control when another printing medium is issued. For example, in order to suit issue of linerless labels, power-feeding from the battery 181 to the printing device 140 and the transfer device 150 may be controlled (linerless-label mode). For peel-off of the linerless labels, the above-mentioned peel-off function of the transfer device 150 is unnecessary. The power necessary for the transfer device 150 in the linerless-label mode corresponds to a force for peeling off the adhesive layers of the linerless labels from the printing surface (adhesive force).

It should be noted that the programs executed in the printer 100 of the embodiment described above are previously incorporated in the ROM or the like and then provided.

The programs executed in the printer 100 according to the embodiment described above may be recorded on a computer-readable recording medium such as a CD-ROM (Compact Disc Read Only Memory), a flexible disk (FD), a CD-R (CD recordable), and a DVD (Digital Versatile Disk) in the form of installable or executable file and then provided.

Further, the programs executed in the printer 100 according to the embodiment described above may be provided by being stored in a computer connected to a network such as the Internet, being downloaded via the network, and the like. Furthermore, the programs executed in the printer 100 according to the embodiment described above may be provided or distributed via a network such as the Internet.

The programs executed in the printer 100 according to the embodiment described above have a module configuration including the above-mentioned modules (mode selection module and power-feeding control module). The processor reads a program from the recording medium and executes the program, and then loads the modules on a main memory. With this configuration, the mode selection module and the power-feeding control module are generated on the main memory.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer, comprising:

a printing device that performs printing on a label attached to a backing sheet;

a platen roller that comes into pressure contact with the printing device and sandwiches the backing sheet with the printing device to convey the label attached to the backing sheet in a conveying direction;

a curved base that is provided on the downstream side of the conveying direction with respect to the printing device and curves the backing sheet;

a peel-off roller that comes into close contact with the platen roller and sandwiches the backing sheet curved by the curved base with the platen roller to convey the backing sheet;

a peel-off roller support mechanism that abuts and separates the peel-off roller against the platen roller by rotatably supporting the peel-off roller;

a sensor that detects the position of the peel-off roller supported by the peel-off roller support mechanism;

a motor that rotates the platen roller;

a battery that supplies power to the printing device and the motor; and a processor that controls the supply power value from the battery to supply power of a first power value to the motor when the detected position is a position where the peel-off roller separates from the platen roller, and controls the supply power value from the battery to supply power of a second power value larger than the first power value to the motor when the detected position is a position where the peel-off roller comes into close contact with the platen roller.

2. The printer according to claim 1, wherein the platen roller conveys the label by a conveying force corresponding to the power supplied from the battery to the motor.

3. The printer according to claim 2, wherein the curved base peels off the printed label from the backing sheet by the conveying force, and the peel-off roller conveys the backing sheet from which the printed label is peeled off by the conveying force.

4. The printer according to claim 1, wherein the first and second values are set in advance as current values.

5. The printer according to claim 1, wherein the printing device includes a plurality of heating elements, and the processor changes the number of simultaneously energizable heating elements on the basis of the power supplied to the printing device.

6. The printer according to claim 1, wherein the processor controls the power supply from the battery such that the power supplied to the printing device is larger than the power supplied to the motor when the detected position is a position where the peel-off roller separates from the platen roller, and controls the power supply from the battery such that the power supplied to the motor is larger than the power supplied to the printing device when the detected position is a position where the peel-off roller comes into close contact with the platen roller.

* * * * *